United States Patent [19]

Asal

[11] 4,364,439

[45] Dec. 21, 1982

[54] IMPLEMENT ASSEMBLY WITH PIVOT CONNECTION

[75] Inventor: Jerrold R. Asal, Channahon, Ill.

[73] Assignee: Caterpillar Tractor Co., Peoria, Ill.

[21] Appl. No.: 280,382

[22] PCT Filed: Apr. 27, 1982

[86] PCT No.: PCT/US81/00551

§ 371 Date: Apr. 27, 1981

§ 102(e) Date: Apr. 27, 1981

[87] PCT Pub. No.: WO 82/03882
PCT Pub. Date: Nov. 11, 1982

[51] Int. Cl.[3] ..... E02F 3/76
[52] U.S. Cl. ..... 172/821
[58] Field of Search ..... 172/811–827

[56] References Cited

U.S. PATENT DOCUMENTS

| | | | |
|---|---|---|---|
| 2,687,568 | 8/1954 | Dickinson | 172/821 |
| 2,749,630 | 6/1956 | Nave | 172/821 |
| 2,950,550 | 8/1960 | French | 172/821 |
| 3,083,480 | 4/1963 | Kirchler | 172/825 |
| 3,084,461 | 4/1963 | Beckford | 172/821 |
| 3,631,930 | 1/1972 | Peterson | 172/821 |
| 3,670,825 | 6/1972 | Asal et al. | 172/821 |
| 3,674,096 | 7/1972 | Berg | 172/821 |
| 3,933,207 | 1/1976 | Frisbee | 172/824 |
| 3,991,832 | 11/1976 | Cooper | 172/825 |
| 4,013,132 | 3/1977 | Matsuzawa | 172/821 |
| 4,081,036 | 3/1978 | Yokoyama | 172/821 |
| 4,221,267 | 9/1980 | Asal et al. | 172/821 |
| 4,281,721 | 8/1981 | Beals | 172/821 |

*Primary Examiner*—Richard J. Johnson
*Attorney, Agent, or Firm*—Claude F. White

[57] ABSTRACT

An implement assembly (12) includes an implement (16), such as a blade (22) of a work vehicle (10), connected to a frame (14) through a pivot connection (23) for pivotally supporting the blade (22). The blade (22) and frame (14) are closely positioned to the front of the work vehicle for maximum stability and balance of the vehicle (10). A first apparatus (18) tilts the blade (22) generally vertically and a second apparatus (20), such as fluid cylinders (40,42), moves the blade (22) to selected angular positions relative to the vehicle (10). The pivotal connection (23) has first, second, and third pivot axes (127,129,131) which allows the blade (22) to tilt and angle in various combinations without binding of the blade (22). A subframe (50) is pivotally connected to the frame (14) and to the second apparatus (20). The blade (22) moves along the subframe (50) during tilting, and with the subframe (50) during angling. The subframe (50) substantially eliminates lateral movement of the fluid cylinders (40,42) during angling of the blade (22) and provides for mounting of the blade (22) and frame (14) close to the front of the work vehicle (10).

10 Claims, 4 Drawing Figures

10
22
74
56
12
66
50
58
16
80
26
70
62
20
32
24
52
46
47
23
58
25
42
36
28
60
14
34
45
40
30
54
72
18
44
14
68
65
64
76

24
77
66
62
50
28
75
70
60
30
42
23
74
36
73
22
77
38
72
68
40
75
65
14

IMPLEMENT ASSEMBLY WITH PIVOT CONNECTION

DESCRIPTION

TECHNICAL FIELD

The invention relates to an angling and tilting implement assembly associated with a work vehicle. More particularly, the invention relates to the use of a subframe pivotally connected to a frame supporting an implement and to means for angling and tilting said implement, said implement being controllably movable along said subframe during tilting operations and controllably movable with said subframe during angling operations. A pivot connection having three pivot axes joins the implement to the supporting frame.

BACKGROUND ART

In the use of an implement on a work vehicle, it is desirable to position the implement and a frame supporting said implement closely to the front of said vehicle for improved balance and stability during vehicle operations. The apparatus of U.S. Pat. No. 4,221,267 which issued to Jerrold R. Asal et al on Sept. 9, 1980 provides for controlled positioning of the frame and implement while maintaining satisfactory implement operation and minimizing weight of the associated elements. The present invention relates to a pivot connection which provides for universal type of motion of the implement with respect to the supporting frame.

U.S. Pat. No. 2,950,550 which issued on Aug. 30, 1960, to J. L. French discloses a tractor blade movably connected to a blade supporting subframe by plates movably positioned in tracks of the blade. The subframe is pivotally connected to the main or C-frame of the vehicle and accommodates tilting and angling of the blade. U.S. Pat. Nos. 3,083,480 and 3,084,461 which issued on Apr. 2, 1963, to L. Kirchler and on Apr. 9, 1963, to J. J. Beckford, respectively, also disclose embodiments of a blade connected to a supporting subframe which is connected to a main or C-frame.

U.S. Pat. No. 3,670,825 which issued to J. Asal et al on June 20, 1972, discloses a vehicle blade having a subframe member pivotally connected thereto and to a main or C-frame. The subframe member moves in positioning plates on the blade for positioning the subframe ends relative to the blade.

For example, a track-type tractor commonly has a frame mounted blade for performing various earthmoving or pushing operations. The blade is generally tiltable about a longitudinal axis of the vehicle or frame and movable through various angles relative to the tractor in a plane passing through said axis. These tilt and angle adjustments provide for the controlled positioning of the blade for more flexible use in the varying situations encountered during work operations. Hydraulic cylinders commonly perform these tilt and angle operations with the cylinders being connected to the frame and blade in preselected locations.

The blade is most commonly connected to and supported by a main or C-frame of the associated tractor. The hydraulic cylinders which "angle" the blade are each positioned between a respective track and the body of the tractor. In "tilting" the blade, the angle cylinders, of necessity, move laterally and can interfere with the tracks or body of the vehicle owing to their connection to the blade. This lateral movement limits the degree of tilt available and necessitates positioning the blade and forward portion of the C-frame an undesirable distance from the tractor in order to maintain satisfactory tilt and angle parameters. The resultant weight forward of the tractor can also decrease stability and balance of the vehicle for certain operations.

In some blade assembly embodiments, the blade has been mounted to a subframe which is in turn pivotally connected to the main or C-frame. The subframe thus supports the blade. The angle cylinders are connected to the C-frame and to either the subframe or the blade, but the tilt cylinders are connected to said subframe and the blade. This subframe arrangement tends to provide greater freedom of tilting and angling. However, the weight of the subframe necessary to support the blade, plus lateral movement of the angling cylinders if connected directly to the blade, also can decrease stability and balance of the vehicle and limit blade movement necessary for some operations.

Many blade assemblies which have angling and tilting capabilities have pivot connections between the blade and the frame which allow two degrees of pivot motion of the blade. However, when the blade is angled and then tilted, or vice versa, the blade binds and will not simultaneously perform the two functions.

The present invention is directed to overcoming one or more of the problems as set forth above.

DISCLOSURE OF THE INVENTION

In one aspect of the prevent invention, an implement assembly has a frame having a longitudinal axis and an implement pivotally connected to said frame by a pivot connection having three axes of pivot motion. First means is provided for controllably pivotally moving said implement about the longitudinal axis. Second means is provided for controllably pivotally moving said implement in a plane passing through said longitudinal axis. The implement assembly has a subframe pivotally connected to said frame and said second means and positioned adjacent and in contactable relationship with said implement. The implement is pivotally movable about said longitudinal axis along said subframe and pivotally movable in said plane with said subframe.

In another aspect of the present invention, an implement assembly has a subframe, an implement, and a frame having a longitudinal axis. The subframe is pivotally connected to the frame and the implement is pivotally joined to the frame by a pivot connection having three axes of pivot motion. First means is provided for controllably pivotally moving said implement about the longitudinal axis. Second means is provided for controllably pivotally moving said implement in a plane passing through said longitudinal axis. In said implement assembly, the implement is directly pivotally connected to said frame and the subframe is positioned adjacent and in contactble relationship with said implement and connected to said second means.

The implement is, for example, a blade of a track-type tractor. The blade and frame supporting said blade are desirably closely positioned to the front of the tractor for better stability and balance. The second means, such as angling hydraulic cylinders, is connected to the subframe. Use of the first means to "tilt" the blade moves said blade relative to and alongside the subframe which eliminates lateral movement of the angling hydraulic cylinders. The blade and frame can thus be closely positioned to the front of the tractor without interference of said cylinders with the tractor and the weight of the implement assembly is minimized by said configuration of the implement assembly. By this construction, the blade can also be angled and tilted at the same time without the blade binding and resisting the desired, controlled blade movements.

BEST MODE FOR CARRYING OUT THE INVENTION

Figure 1:
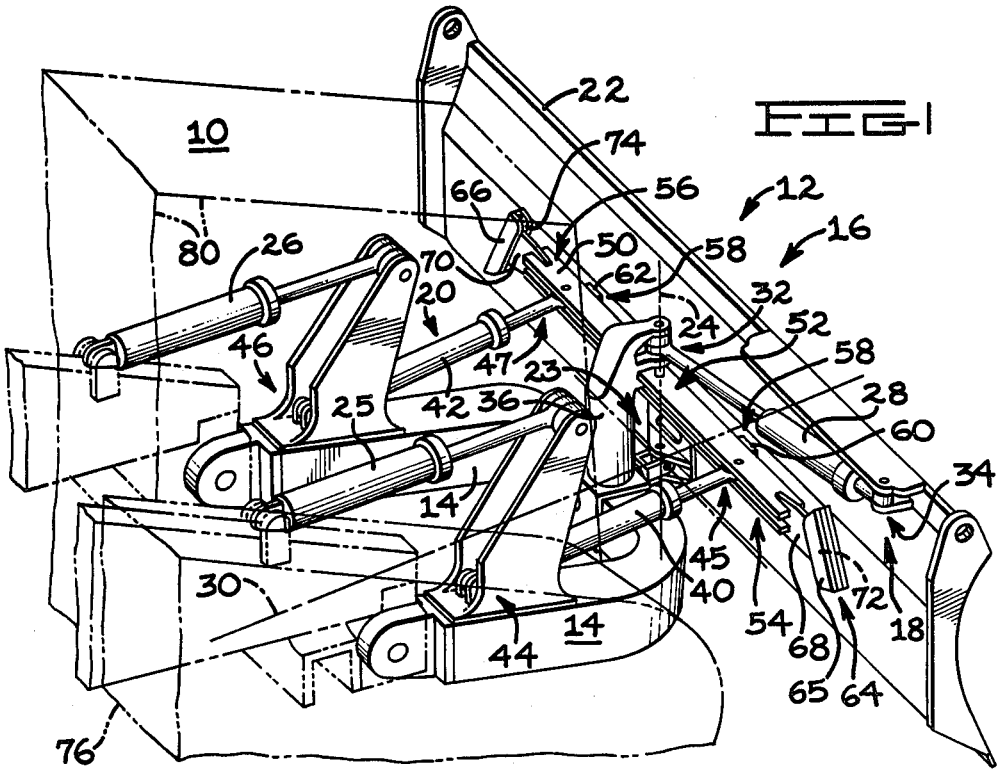
FIG. 1 is a diagrammatic perspective view showing an embodiment of the invention on a track-type tractor.

Referring to the drawings, a work vehicle 10 has an implement assembly 12. The work vehicle 10 is shown, for example, as a track-type tractor 10. The implement assembly 12 includes a frame 14, an implement 16 and first and second means 18,20. The implement 16 is, for example, a blade 22. The blade 22 is directly pivotally connection to the frame 14. Said blade 22 is shown, for example, connected to said frame 14 through a pivotal connecting 23 which defines a plurality of axis, as will be hereinafter more fully explained. The frame 14 is of a "C" configuration and of a construction sufficient for supporting the blade 22 by the direct connection with said blade 22. Said frame 14 is pivotally connected to the tractor 10 and first and second hydraulic lift cylinders 25,26 controllably, pivotally move the frame 14 relative to the tractor 10 for raising and lowering the blade 22.

Figure 2:
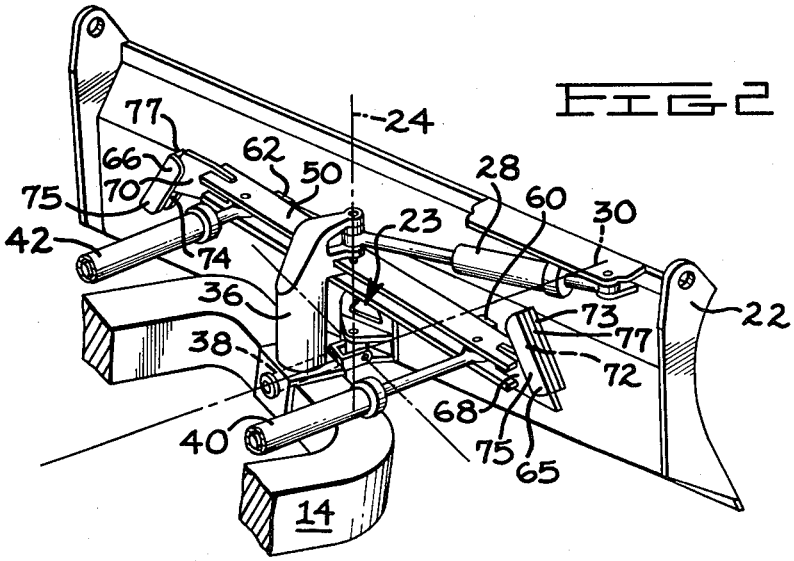
FIG. 2 is a diagrammatic perspective view showing the embodiment of FIG. 1 in greater detail.

The first means 18, such as a hydraulic tilt cylinder 28, is provided for controllably pivotally moving the blade 22 about a longitudinal axis 30 of the frame 14 and relative to the frame 14. Said first means 18 or tilt cylinder 28 is preferably pivotally connected to said frame 14 on the vertical axis 24 of the pivotal connection 23 and is pivotally movable about said vertical axis 24. The tilt cylinder 28 has first and second ends 32,34. The first end 32 is pivotally connected to the frame 14 on the vertical axis 24, preferably through a tower member 36 of said frame 14. The second end 34 is pivotally connected to the blade 22. Said tilt cylinder ends 32,34 can also be reversed. The tilt cylinder 28 is thus controllably actuatable to controllably "tilt" the blade 22 about the longitudinal axis 30, owing to the orientation of a rotatable pin 38 in the pivotal connection 23 of the frame 14 with the blade 22, as is best seen in FIG. 2.

The second means 20, such as first and second hydraulic angle cylinders 40,42, is provided for controllably, pivotally moving the blade 22 in a plane passing through the longitudinal axis 30. Said blade 22 controllably pivotally moves relative to the frame 14. The first and second angle cylinders 40,42 each have first and second ends 44,45,46,47. Said first ends 44,46 are pivotally connected to the frame 14. Said second ends 45,47 are positioned relative to the blade 22, as will be hereinafter discussed. Said angle cylinders 40,42 can also be reversed. The angle cylinders 40,42 are controllably actuatable to controllably "angle" the blade 22 in the plane passing through the longitudinal axis 30, owing to a pivot block 83 defining the vertical axis 24 in the pivotal connection 23 of the frame 14 with the blade 22. Said plane is defined by the relative tilt position of the blade 22, owing to moving or tilting said blade 22 about the longitudinal axis 30. A further discussion of the pivotal connection 23 will be given at a later point in the description.

The first and second means 18,20 are used to controllably position a blade or other implement relative to the tractor for performing different work functions.

The implement assembly 12 has a subframe 50 pivotally connected to the frame 14 and the second means 20 or angle cylinders 40,42. Said subframe 50 is positioned adjacent and in contactable relationship with the blade 22. Therefore, the subframe 50 is free from connection with the blade 22. The direct pivotal connection of the blade 22 to the frame 14 thus by definition excludes a connection of said blade 22 and frame 14 through the subframe 50. As is shown, the subframe 50 is substantially free from forces of gravity exerted on the blade 22. The frame 14 supports the blade 22 through the pivotal connection 23 with said blade 22.

The blade 22 is pivotally movable about the longitudinal axis 30 of the frame 14 along said subframe 50. In other words, the blade 22 moves relative to and alongside the subframe 50 in response to "tilting" said blade 22. Preferably, the blade 22 is pivotally, slidably movable about the longitudinal axis 30 along said subframe 50. Said blade 22 is pivotally movable in said plane passing through the longitudinal axis 30 with said subframe 50. In other words, the blade 22 and subframe 50 move one with the other in said plane, such as during "angling" operations of the blade 22. The relationship of said subframe 50 and the associated elements will be hereinafter more fully discussed.

The subframe 50 has a middle portion 52 and first and second end portions 54,56 and is pivotally connected at the middle portion 52 to the frame 14. It is desirable that the subframe 50 be pivotally connected to said frame 14 on the vertical axis 24 and pivotally movable about said vertical axis 24. Said subframe 50 is connected to the frame 14 at the tower member 36 of said frame 14. The second ends 45,47 of the angle cylinders 40,42 are pivotally connected to the subframe 50. Said second ends 45,47 are each connected to a respective one of the first and second end portions 54,56 of said subframe 50. The second end 45 of the first angle cylinder 40 is shown, for example, connected to said first end portion 54.

The subframe 50 also can have a bearing pad 58. The bearing pad 58 has first and second portions 60,62 each positioned on the first and second end portions 54,56 of the subframe 50, respectively. The bearing pad 58 abuts the blade 22 in response to moving the blade 22 with said subframe 50. The bearing pad 58 is in slidable contact with said blade 22 in response to moving said blade 22 along the subframe 50. In tilting operations, the tilt cylinder 28 exerts opposing forces on the blade 22 and frame 14 to slide said blade 22 along the bearing pad 58 to a desired tilt position.

Controllably actuating the angle cylinders 40,42 to "angle" the blade 22 exerts forces on the subframe 50. Said subframe 50 is of a construction sufficient for receiving and transmitting generally horizontal forces exerted on the blade 22, such as those above mentioned or those exerted on the blade 22 during earthmoving operations. The forces exerted by the angling cylinders 40,42, for example, are received by the subframe 50 and transmitted through the bearing pad 58 to the blade 22 for pivotally moving or "angling" said blade 22 with said subframe 50. The subframe 50 and blade 22 both pivotally move one with the other about the vertical axis 24, owing to their respective pivotal connections with the frame 14 on said vertical axis 24.

The implement assembly 12 includes third means 64 for maintaining the subframe 50 at a preselected position relative to the blade 22 in response to pivotally moving said blade 22 about the longitudinal axis 30 along said subframe 50. The third means 64 includes a first guiding element 65 connected to the blade 22. The implement assembly 12 preferably includes a second guiding element 66 connected to the blade 22. Each of said guiding elements 65,66 in the embodiment shown are of a configuration sufficient for engageably maintaining the first and second end portions 54,56 of the subframe 50, respectively, at respective preselected positions relative to said blade 22 in response to pivotally moving said blade 22 about the longitudinal axis 30 along the subframe 50. Said preselected positions are hereinafter fully discussed.

The subframe 50 has first and second guide members 68,70 positioned on the first and second end portions 54,56 of the subframe 50, respectively. The guiding elements 65,66 each define an opening 72,74 between first and second blocks 73,75 in which the related guiding members 68,70 are engageably positioned. Said guide members 68,70 slide relative to the guide elements 65,66 in said respective openings 72,74. The blocks 73,75 are used to provide a wear resistant surface for the guide members 68,70. In tilting the blade 22, said blade 22 is movable along the subframe 50, but is blocked from pivotally moving about the vertical axis 24 separate from the subframe 50 in response to forces exerted on said blade 22 during use of the implement assembly 12. The preselected positions of the subframe 50 relative to the blade 22 are thus defined relative to movement about the longitudinal axis 30 by the degree of tilt of the blade 22 and relative to movement in the plane passing through said axis 30 by the clearance of the guide members 68,70 in the respective related openings 72,74. Said clearances are adjustable owing to the use of shims 77 to determine the size of said openings 72,74.

Figure 3:
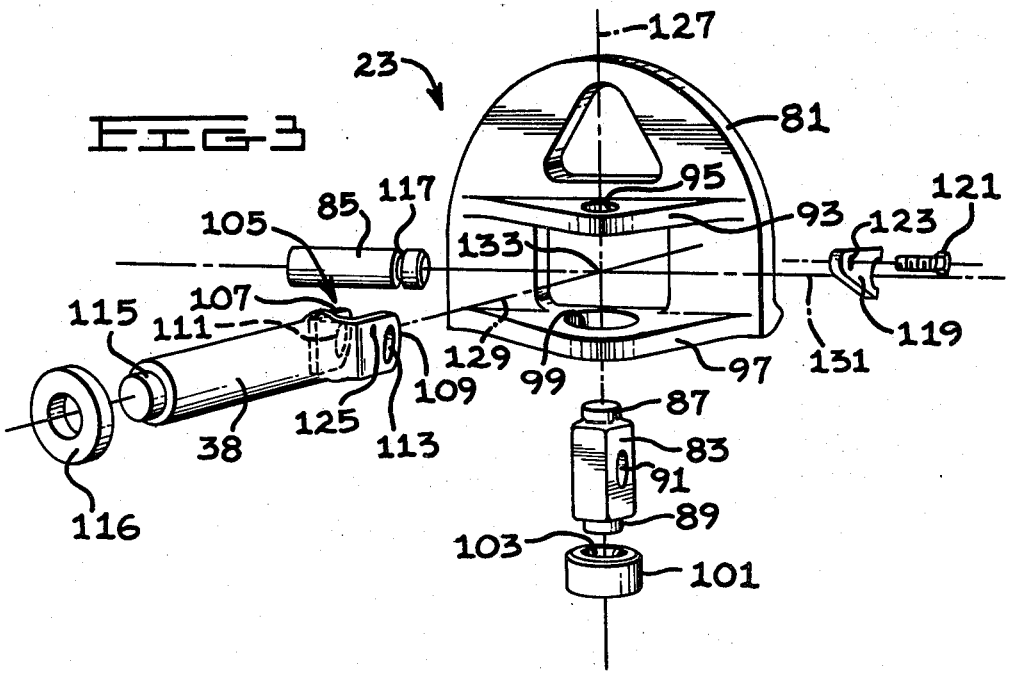
FIG. 3 is a diagrammatic exploded view of the pivotal connection of the present invention.
Figure 4:
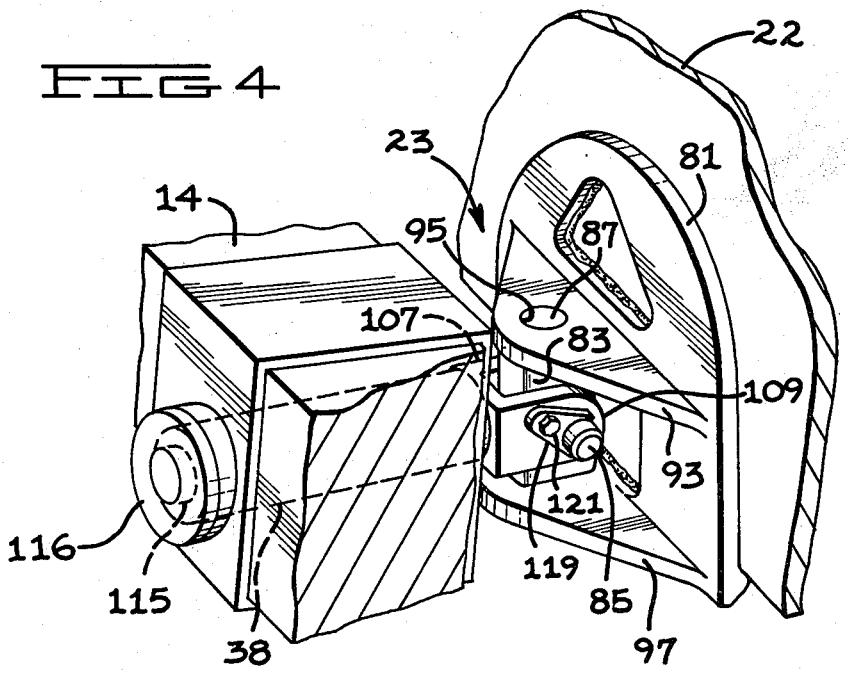
FIG. 4 is a diagrammatic perspective view of the pivotal connection of FIG. 3 with the various parts assembled.

Referring particularly to FIGS. 3 and 4, the pivotal connection 23 has a bracket 81 which is secured to the rear of the blade 22, as by welding, a pivot block 83, a pivot shaft 85, and a rotatable pin 38. The pivot block 83 has first and second bosses 87 and 89 and a through bore 91. The bracket 81 has an upper flange 93, which has a bore 95, and a lower flange 97, which has a bore 99. At assembly of the connection 23, the pivot block 83 joins the bracket 81 with the boss 87 fitting within the bore 95 and boss 89 fitting within the bore 99. The bore 99 is of sufficient diameter to accept the pivot block 83. With the pivot block in place, a sleeve 101, having a bore 103, is positioned in the bore 99 and secured, as by welding to the bracket 81. The boss 89 fits within the bore 103 and the pivot block 83 is rotatably secured to the bracket 81 with the bore 91 positioned between the flanges 93 and 97 and essentially parallel thereto.

The rotatable pin 38 has a bifurcated front portion 105, having first and second flanges 107,109. A bore 111 extends through the flange 107 and another bore 113, in axial alignment with bore 111, extends through flange 109. The pin 38 has a reduced diameter rear portion 115. The bifurcated portion of the pin 38 encompasses the pivot block 83 with the flanges 107,109 positioned on each side of the pivot block. In this position, the bores 111,91,113 form an aligned passageway. The pivot shaft 85 is inserted through this passageway and pivotally secures the pin 38 to the block 83.

The pivot shaft 85 has a groove 117 for receiving a retainer 119 and lock the shaft against axial movement. A threaded fastener 121 extends through an opening 123 in the retainer 119, screws into a threaded opening 125 in the flange 109, and secures the retainer in place. The pin 38 is inserted through an opening on the centerline of the frame 14 with the reduced diameter portion 115 extending outwardly from the rear surface of the frame. A retainer 116 is welded to the reduced diameter portion 115 and pivotally connects the frame 14 to the blade 22. With the various components fully assembled, the pivot connection has a first pivot axis 127, a second pivot axis 129, and a third pivot axis 131.

Referring to FIGS. 1, 2, 3 and 4, the vertical axis 24 is colinear with the pivot axis 127 and the longitudinal axis 30 is colinear with the axis 129. Referring to FIG. 3, the first, second, and third axes 127,129,131 intersect at a common point 133. In view of the three distinct pivot axes 127,129, and 131 of the pivotal connection 23, the blade 22 can be angled and tilted, singularly or in combination, without the blade 22 binding or sticking.

It should be understood that the implement assembly 12 and work vehicle 10 can be of other configurations as is known in the art without departing from the invention.

INDUSTRIAL APPLICABILITY

In the use of the implement assembly 12, actuation of the tilt cylinder 28 pivotally moves or tilts the blade 22 by sliding said blade 22 relative to the subframe 50. Actuation of the angle cylinders 40,42 pivotally moves or angles the blade 22 by exerting forces on the subframe 50 to pivotally move said subframe 50 and the blade 22 one with the other. The blade 22 is shown both "tilted" and "angled" in FIG. 2.

The angle cylinders 40,42 are positioned between a respective track 76 (one of which is shown in outline in FIG. 1) and body 80 of the tractor 10 and aligned generally parallel to the longitudinal axis 30 of the frame 14. When actuated, said cylinders 40,42 each extend or retract to position the blade 22 at a desired angle while remaining generally parallel to the longitudinal axis 30 and free from interference with the tracks 76 or body 80. Actuation of the tilt cylinder 28 moves the blade 22 relative to the subframe 50 which results in substantially no lateral movement of the subframe connected angle cylinders 40,42. Therefore, the blade 22 and frame 14 can be positioned closely to the front of the tractor 10 while maintaining satisfactory extension of the angle cylinders 40,42 for maximum angling of the blade 22.

Weight of the implement assembly 12 is minimized in the present invention, owing to the blade 22 being supported by the frame 14 through the pivotal connection 23 with said blade 22. The subframe 50 is of a construction sufficient to withstand substantially only the horizontal forces which are received and transmitted by said subframe 50, such as in angling the blade 22 or during earthmoving operations. The resulting reduction in front end weight of the tractor 10 substantially overcomes problems of balance associated therewith.

With the three distinct pivot axes 127, 129, and 131 of one pivotal connection 23, the blade 22 can be angled and tilted in any combination of these motions without the blade 22 becoming bound.

Other aspects, objects and advantages of this invention can be obtained from a study of the drawings, the disclosure and the appended claims.

I claim:

1. In an implement assembly (12) having a frame (14) having a longitudinal axis (30), an implement (16), a pivot connection (23) defining a substantially vertical axis (24), a subframe (50) pivotally connected to said frame (14) and positioned adjacent and in contactable relationship with said implement, first means (18) for controllably pivotally moving said implement (16) about the longitudinal axis (30) relative to said frame (14) and second means (20) for controllably pivotally moving said implement (16) about said substantially vertical axis (24), said implement (16) being directly pivotally connected to said frame (14) by said pivot connection (23), the improvement comprising:

said pivotal connection (23) having first, second, and third pivot axis (127,129,131) intersecting at a common point (133), said pivotal connection (23) including a bracket (81) having upper and lower flanges (93,97), a pivot block (83) having a bore (91) and being secured between said flanges (93,97), a pin (38) having a first flange (107) having a bore (111) and a second flange (109) having a bore (113), said bores (91,111,113) forming an aligned passageway, and a pivot shaft (85) fitted within said passageway and securing said pin (38) to said block (83).

2. The implement assembly (12), as set forth in claim 1, wherein said implement (16) pivotally moves about said longitudinal axis (30) in sliding relationship with said subframe (50).

3. The implement assembly (12), as set forth in claim 1, wherein said first means (18) is pivotally connected to the frame (14) on said vertical axis (24) and pivotally movable about said vertical axis (24).

4. The implement assembly (12), as set forth in claim 1, wherein said subframe (50) is substantially free from forces of gravity exerted on said implement (16).

5. The implement assembly (12), as set forth in claim 1, wherein said subframe (50) is of a construction sufficient for receiving and transmitting generally horizontal forces exerted on said implement (16).

6. The implement assembly (12), as set forth in claim 1, wherein said first and second means (18,20) include tilt (28) and first angle (40) hydraulic cylinders, respectively, said cylinders (28,40) each having first and second ends (32,34,44,45) said first and second (32,34) ends of the tilt cylinder (28) being pivotally connected to the frame (14) and implement (16), respectively, said first and second ends (44,45) of the first angle cylinder (40) being pivotally connected to the frame (14) and subframe (50), respectively.

7. The implement assembly (12), as set forth in claim 1, including third means (64) for maintaining said subframe (50) at a preselected position relative to said implement (16) in response to pivotally moving said implement (16) about the longitudinal axis (30).

8. The implement assembly (12), as set forth in claim 7, wherein said third means (64) includes a first guiding element (65) connected to the implement (16) and defining an opening (72) and wherein the subframe (50) has a first guide member (68) movably positioned in said opening (72).

9. The implement assembly, as set forth in claim 1, wherein the subframe (50) has a middle portion (52) and first and second end portions (54,56) and is pivotally connected at the middle portion (52) to said frame (14) and the second means (20) includes first and second angle cylinders (40,42) each having first and second ends (44,45;46,47), said first ends (44,46) each being connected to said frame (14), said second ends (45,47) each being connected to a respective one of the first and second end portions (54,56) of said subframe (50).

10. The implement assembly (12), as set forth in claim 9, including first and second guiding elements (65,66) connected to said implement (16) and each being of a configuration sufficient for maintaining said first and second end portions (54,56) of said subframe (50), respectively, at respective preselected positions relative to said implement (16) in response to pivotally moving said implement (16) about said longitudinal axis (30).

* * * * *